United States Patent [19]

Fagliano et al.

[11] 4,151,928

[45] May 1, 1979

[54] TRASH BIN COVER

[75] Inventors: Robert J. Fagliano, Walnut Creek; Ross C. Burkhardt, Berkeley; Bruce W. Scharmer, San Ramon, all of Calif.

[73] Assignee: E-Z Lift Corporation, Walnut Creek, Calif.

[21] Appl. No.: 917,805

[22] Filed: Jun. 22, 1978

[51] Int. Cl.[2] ..... B65D 43/14; B65D 51/04

[52] U.S. Cl. ..... 220/343; 220/1 T

[58] Field of Search ..... 220/1 T, 1.5, 254, 331, 220/334, 343, 254

[56] References Cited

U.S. PATENT DOCUMENTS

| | | | |
|---|---|---|---|
| 3,015,405 | 1/1962 | Sterling | 220/1 T |
| 3,136,575 | 6/1964 | Kolling | 220/343 X |
| 3,362,561 | 1/1968 | Bakos | 220/343 X |
| 3,618,803 | 11/1971 | Dobberkau | 220/1.5 |

*Primary Examiner*—George T. Hall

*Attorney, Agent, or Firm*—Naylor, Neal & Uilkema

[57] ABSTRACT

A cover for open topped trash bins. The cover is fabricated of a high strength resilient polymer sheet material, such as ABS, CYCOLAC, or LUSTRAN and is formed with a central section reinforced by deformations and a generally planar peripheral section. The peripheral section is proportioned for abutting engagement with the upper edges of the open top of a bin with which the cover is used. A hinge is integrally jointed to one edge of the cover to provide for mounting of the cover on a bin and select pivotal movement of the cover between open and closed conditions relative to the top of the bin.

11 Claims, 5 Drawing Figures

TRASH BIN COVER

BACKGROUND OF THE INVENTION

The present invention relates to an improved trash bin cover and, more particularly is directed to such a cover for use with relatively large commercial refuse bins of the type handled by mechanical refuse trucks.

Refuse bins of the type with which the present invention is concerned are generally fabricated of steel and provided with hinged steel lids. Such lids are expensive to fabricate and have the disadvantage that they are relatively easily damaged in mechanical handling. They also have the disadvantage that they are heavy and, for this reason, pose a hazard to the user loading the bin. Yet another disadvantage of such lids is that they are difficult and expensive to repair, should they become damaged. As a result of the difficulty of repair, it is not unusual that damaged lids go unrepaired, with the consequence that the trash bin is not effectively sealed when not in use.

Although the prior art suggests the provision of relatively light weight covers for trash receptacles, these covers are not suitable for use on commercial trash bins of the type with which the present invention is concerned. Examples of such prior art covers may be seen in U.S. Pat. Nos. 1,499,919 and 3,935,964, as well as German Pat. No. 1,012,559. The prior art also suggests the use of corrugated walls and enclosures on receptacles. Such walls and enclosures may be found in the following United States Patents: U.S. Pat. Nos. 559,833; 1,099,194; 2,117,228; 3,618,803; 3,706,392; 3,828,965; and Des. 193,253. Although the corrugations shown on the structures in the latter patents have an appearance somewhat similar to the corrugations employed at the preferred embodiment of the present invention, the patents do not suggest the provision of a light weight cover of the type with which the present invention is concerned.

SUMMARY OF THE INVENTION

The cover of the present invention is characterized in that it is fabricated of a sheet of flexible polymer material which is deformed in its central area for purposes of reinforcement and provided with a generally planar peripheral section designed for sealing engagement with the edges of a bin. No depending flanges are provided around the peripheral section. As a result of the absence of depending flanges, the cover need not be accurately tailored to the bin with which it is used and there is no possibility that a depending flange may become deformed and interfere with the operation of the cover. The cover is also characterized in that a hinge is integrally joined to one of its sides. The hinge serves both to mount the cover for movement between open and closed conditions and to reinforce the cover. In a preferred embodiment, the hinge comprises a tubular segment twisted directly into the sheet material of the cover and a hinge pin or rod extending through the segment.

A principal object of the present invention is to provide a light weight durable cover for trash bins.

Another object of the invention is to provide such a cover which effectively seals the open top of a trash bin without the necessity of having a tailored flange to extend around the top of the bin.

Still another object of the present invention is to provide such a cover with an integrally formed hinge to mount the cover on a trash bin.

The foregoing and other objects will become more apparent when viewed in light of the accompanying drawings and followed detailed description.

DESCRIPTION OF THE PREFERRED EMBODIMENT

Figure 1:
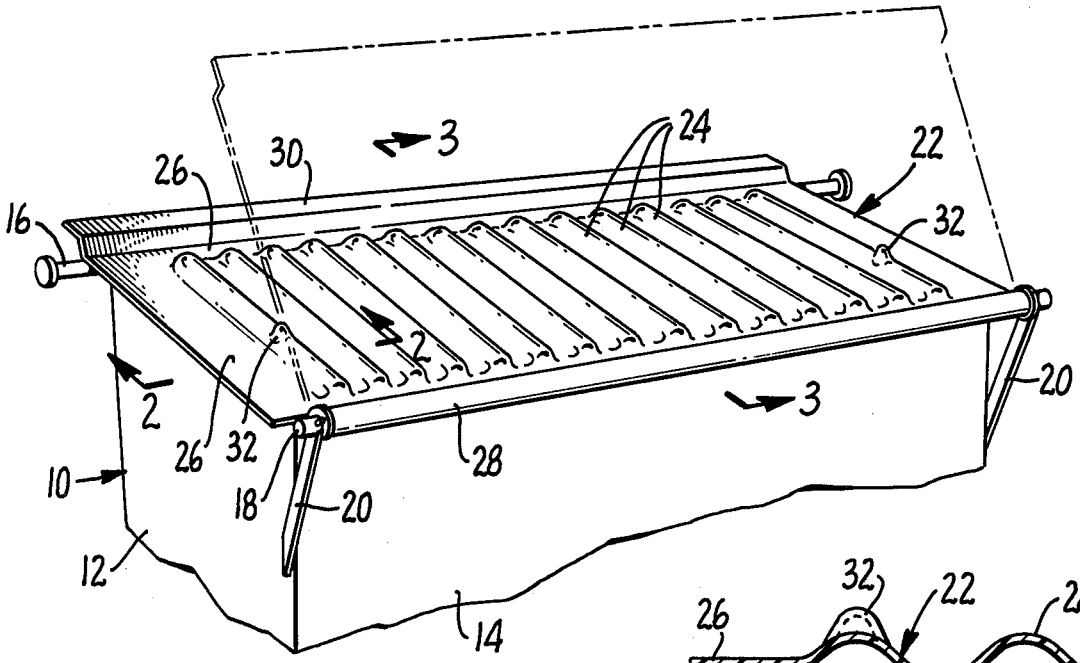
FIG. 1 is a perspective view of a trash bin, showing the cover of the present invention in place on the bin.

Referring now to FIG. 1, the bin or receptacle is designated by the numeral 10. The bin is of conventional construction and is typically fabricated of steel. It comprises end walls 12, side walls 14, a bottom (not shown), and an open top, over which the cover of the present invention is adapted to extend. A lift rod 16 is fixidly secured to one of the side walls to facilitate handling of the container by a mechanized refuse truck. A hinge pin or a rod 18 is mounted to the other side of the bin by brackets 20. The upper edges of the end walls 12 and side walls 14 are disposed in coplanar relationship (see FIG. 3).

Figure 2:
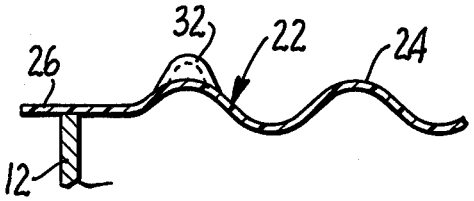
FIG. 2 is a cross-sectional view taken on the plane designated by line 2—2 of FIG. 1.
Figure 3:
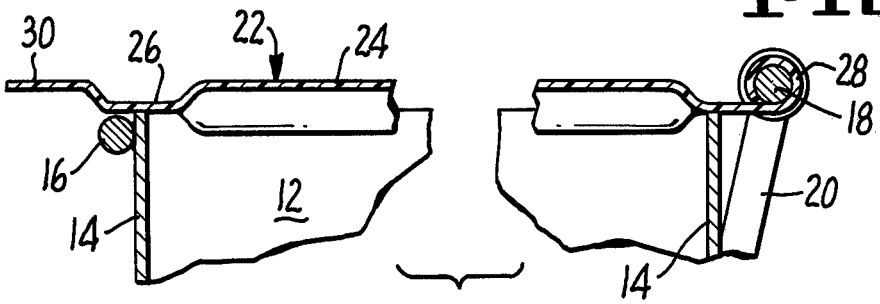
FIG. 3 is a cross-sectional view taken on the plane designated by line 3—3 of FIG. 1, illustrating in detail the hinge mounting means.

The FIGS. 1–3 embodiment of the cover is designated in its entirety by the numeral 22. It comprises: a central section reinforced by deformations in the form of corrugations 24; a planar peripheral section 26 extending around the central section; a rolled hinge section 28 extending around the rod 18; and, a raised or deformed lift section 30 extending from the portion of the peripheral section opposite the hinged section.

In the preferred embodiment, the cover 32 is fabricated of a polymer material, such as ABS (acrylonitrile butadiene styrene) CYCOLAC (manufactured by the Borg Warner Corporation) or LUSTRAN (manufactured by the Monsanto Company.) These materials are available in sheet form which is ideally suited for fabrication into the cover of the present invention. Fabrication of the main body of the cover, including the corrugations 24 and the lift section 30 may be achieved by vacuum forming. The hinge section 28 of the FIGS. 1–3 embodiment is formed by hot twisting technique wherein the section is formed from the same sheet of material as the main body of the cover. During the vacuum forming operation, the peripheral section 26 would be maintained flat by suitable clamping structure.

EXAMPLE

In one example of the invention, wherein the cover was fabricated of $\frac{1}{8}$ inch thick vacuum formed ABS material, the cover had the following dimensions:

Length: 66 inches
Width: 34 inches

Hinge Section I.D.: $1\frac{1}{8}$ inch

Approximate corrugation dimensions: $1\frac{1}{4}$ inch deep; $3\frac{1}{2}$ inches wide; 24 inches long.

In the FIGS. 1-3 embodiment wherein the hinge section 28 is in the form of a roll or a twist having one free edge, the internal diameter of the section is slightly less than that of the rod 18 in order that the hinge section will frictionally engage the rod to hold the cover in place. The cover may also be formed with dimples 32 in the underside thereof for receipt of suitable hold open struts. Although not illustrated, it should be understood that such struts might be pivotally secured to the side walls of the bin for select movement into a position engaged with the dimples to hold the cover in an elevated position relative to the open top of the bin.

The closed condition of the lid is illustrated by the solid line representations in FIGS. 1-3. In this condition, it will be seen that the under surface of the flat peripheral section 26 rests directly upon the upper edges of the bin. The resilient nature of the material from which the cover is fabricated facilitates snug engagement between the peripheral segment and said edges, without the requirement of flanges or special seals. The open or elevated condition of the cover is shown by the phantom line illustration in FIG. 1. It should be appreciated that the relatively light weight of the cover and the flat "flangless" configuration of the peripheral sealing section 26 minimizes the possibility of injury to a user of the bin, should the cover inadvertently fall to the closed condition when the bin is being used. This is in contrast to the danger presented by more conventional heavy steel covers which are provided with downwardly extending flanges that can inflict severe injury to the user, should the cover close when the user's arm or any other part of his body is over the bin.

In the preferred embodiment of FIGS. 1-3, the twisted hinge section 28 and the lift section 30 are disposed in parallel relationship to one another and the corrugations 24 run generally normal to these sections. This combination lends rigidity to the cover, while still permitting it to flex sufficiently to enable the peripheral section 26 to effectively seat on the top edges of the bin walls when the cover is in the closed condition.

Figure 4:
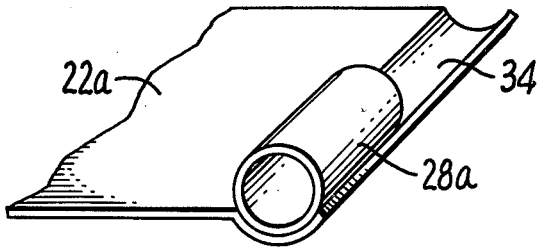
FIG. 4 is a perspective view of the cover of the present invention, with parts broken away, illustrating an alternative hinge construction to that shown in the FIG. 1 embodiment.

FIG. 4 shows a modified cover wherein the hinge section, designated **28*a* is in the form of an extruded plastic pipe integrally joined to the top surface of the cover by gluing or welding. The cover of FIG. 4 is designated by the numeral 22*a* and has a semi-circular groove 34 formed therein for receipt of the hinge section 28*a***.

Figure 5:
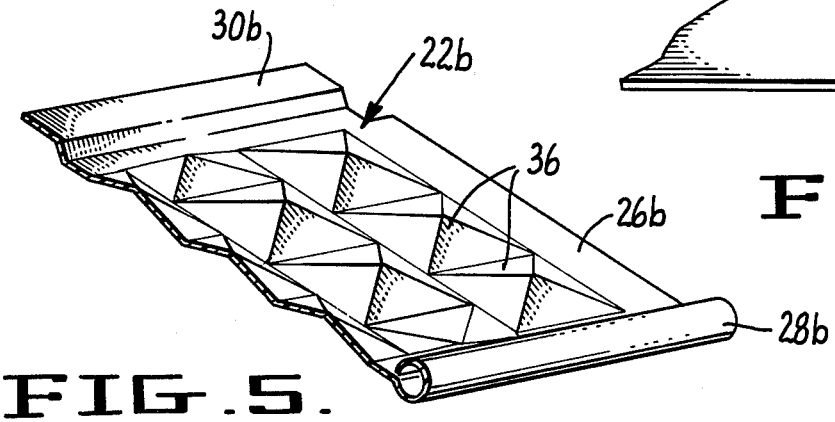
FIG. 5 is a perspective view of the cover of the present invention, illustrating an alternative design for the reinforcing deformations formed in the cover.

The cover shown in FIG. 5 is designated by the numeral **22*b* and differs from that of FIGS. 1-3 primarily in that the reinforcing deformations in the central section take the form of generally pyramidical protrusions 36, rather than corrugations. Another difference between the cover 22*b* and cover 22 is that the hinge section of cover 22*b*, designated 28*b*, is disposed so as to extend above and below the plane of the peripheral section designated 26*b*. The latter difference accommodates a hinge pin located at a slightly lower level than that shown in FIGS. 1 and 3. The lift section 30*b* of the FIG. 5 embodiment is of essentially the same configuration as the section 30 of the FIGS. 1-3** embodiment.

CONCLUSION

Although preferred embodiments of the invention have been illustrated and described, it should be understood that the invention is not intended to be limited to the specifics of these embodiments, but rather defined by the following claims.

What is claimed is:

1. A cover for use with a receptacle having an open top with edges disposed in generally coplanar relationship, said cover comprising: a flexible polymer body having a deformation reinforced central section of an area less than that of the open top of the receptacle and a generally planar peripheral section extending around the central section for engagement with the top edges of the receptacle; and, hinge means to secure the cover to the receptacle for movement between an open condition elevated relative to the top of the receptacle and a closed condition wherein the peripheral section of the cover abuttingly engages the top edges of the receptacle.

2. A cover according to claim 1 wherein the hinge means is disposed to secure the cover to the receptacle for movement about an axis extending along one side of the receptacle and the deformation reinforced central section is formed with corrugations extending normal to said axis.

3. A cover according to claim 2 wherein the hinge means comprises a generally rigid tubular segment integrally joined to and extending along one side of the planar peripheral sections and the portion of the peripheral section opposite said one side is reinforced by a deformed segment extending generally normal to the corrugations.

4. A cover according to claim 1 wherein the hinge means comprises a generally rigid tubular segment integrally joined to and extending along one side of the planar peripheral section.

5. A cover according to claim 4 wherein the rigid tubular segment comprises a section of pipe joined to the body of the cover.

6. A cover according to claim 4 wherein the rigid tubular segment comprises a rolled portion of the body of the cover.

7. A cover according to claim 1 wherein the body of the cover is of generally uniform thickness and the central section is reinforced by impressed protrusions formed therein.

8. A cover for use with a trash receptacle having an open top defining a continuous peripheral edge, said cover comprising a flexible polymer body of generally uniform thickness having a deformation reinforced central section of an area less than that of the open top of the receptacle and a peripheral section extending around said central section for engagement with the peripheral edge defined by the open top of the receptacle; an open ended tubular segment integrally joined to and extending along one side of the peripheral section; a rod received within and extending through the tubular segment, said segment being pivotal about the rod to provide a hinge connection between the rod and segment; and means to support the rod on the receptacle to one side of the open top whereby the rod hingedly secures the cover to the receptacle for select movement between closed and open positions relative to the open top of the receptacle.

9. A lid according to claim 8 wherein the tubular segment comprises a section of pipe joined to the body of the lid.

10. A lid according to claim 8 wherein the tubular segment comprises a rolled portion of the body of the cover, said rolled portion being open along one edge and having an internal diameter slightly less than the external diameter of the rod whereby the segment resiliently and frictionally engages the rod.

11. A cover according to claim 8 wherein the side of the peripheral section opposite that to which the tubular segment is joined is reinforced by a deformation extending generally parallel to the tubular segment.

* * * * *